US012773003B2

(12) United States Patent
Lauenstein et al.

(10) Patent No.: US 12,773,003 B2
(45) Date of Patent: Oct. 27, 2026

(54) METHOD OF MANUFACTURING AN AEROSOL-GENERATING ARTICLE COMPONENT AND AEROSOL-GENERATING ARTICLE INCLUDING SAID COMPONENT

(71) Applicant: PHILIP MORRIS PRODUCTS S.A., Neuchatel (CH)

(72) Inventors: Stefan Lauenstein, Cormondreche (CH); Bertrand Barbou Des Courieres, Peseux (CH); Marc A.F. Van Den Boogaart, Giez (CH)

(73) Assignee: Philip Morris Products S.A., Neuchatel (CH)

( * ) Notice: Subject to any disclaimer, the term of this patent is extended or adjusted under 35 U.S.C. 154(b) by 638 days.

(21) Appl. No.: 17/251,391

(22) PCT Filed: Jun. 28, 2019

(86) PCT No.: PCT/EP2019/067498
§ 371 (c)(1),
(2) Date: Dec. 11, 2020

(87) PCT Pub. No.: WO2020/002695
PCT Pub. Date: Jan. 2, 2020

(65) Prior Publication Data

US 2021/0244080 A1 Aug. 12, 2021

(30) Foreign Application Priority Data

Jun. 29, 2018 (EP) ..... 18181030

(51) Int. Cl.
*A24C 5/01* (2020.01)
*A24B 3/14* (2006.01)
(Continued)

(52) U.S. Cl.
CPC ..... *A24C 5/01* (2020.01); *A24B 3/14* (2013.01); *A24C 5/18* (2013.01); *A24D 1/20* (2020.01)

(58) Field of Classification Search
CPC .... A24C 5/01; A24C 5/18; A24B 3/14; A24D 1/20
See application file for complete search history.

(56) References Cited

U.S. PATENT DOCUMENTS 3,472,236 A * 10/1969 Dearsley ..... A24C 3/00 131/64.1
4,047,536 A 9/1977 Asfour
2017/0245542 A1 8/2017 Zappoli

FOREIGN PATENT DOCUMENTS

JP 51-012999 1/1976
JP 2018-500007 1/2018

OTHER PUBLICATIONS

Office Action issued in Japan for Application No. 2020-569153 dated Jun. 26, 2023 (11 pages). English translation included.
(Continued)

*Primary Examiner* — Michael H. Wilson
*Assistant Examiner* — Jennifer A Kessie
(74) *Attorney, Agent, or Firm* — Mueting Raasch Group

(57) ABSTRACT

The present invention is related to a method of manufacturing an aerosol-generating article component, the method comprising the steps of: •providing a web (210) of a material containing alkaloids; •feeding the web (210) of a material containing alkaloids to an embossing device (310) in a transport direction; •embossing the web (210) of a material containing alkaloids to form an embossed web (220) of a material containing alkaloids by feeding the web (210) between a first and a second embossing rollers (350,360) so that the first and second embossing rollers (350,360) apply an embossing pattern to the web (210), wherein the emboss-
(Continued)

ing pattern includes ridges (240) or troughs (350) extending in a direction orthogonal to the transport direction; •gathering the embossed web (220) of a material containing alkaloids, and •forming a continuous rod using the embossed web (220) of a material containing alkaloids.

9 Claims, 2 Drawing Sheets

(51) Int. Cl.
*A24C 5/18* (2006.01)
*A24D 1/20* (2020.01)

(56) References Cited

OTHER PUBLICATIONS

Search Report and Written Opinion for PCT/EP2019/067498 dated Sep. 25, 2019 (18 pages).

* cited by examiner

METHOD OF MANUFACTURING AN AEROSOL-GENERATING ARTICLE COMPONENT AND AEROSOL-GENERATING ARTICLE INCLUDING SAID COMPONENT

This application is a U.S. National Stage Application of International Application No. PCT/EP2019/067498 filed Jun. 28, 2019, which was published in English on Jan. 2, 2020 as International Publication No. WO 2020/002695 A1. International Application No. PCT/EP2019/067498 claims priority to European Application No. 18181030.0 filed Jun. 29, 2018.

The present invention is related to a method of manufacturing an aerosol-generating article component and to an aerosol-generating article including the aerosol-generating article component obtained from said method.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The starting material for the production of homogenized tobacco material for aerosol-generating article may also be mostly tobacco leaves that have thus the same size and physical properties as the tobacco for the blending of cut filler.

Possible forms of homogenized tobacco material include reconstituted tobacco sheet and cast leaf. The process to form homogenized tobacco material sheets commonly comprises a step in which ground tobacco and a binder are mixed to form a slurry. The slurry is then used to create a tobacco web or sheet, for example by casting a viscous slurry onto a moving metal belt to produce so called cast leaf. Alternatively, a slurry with low viscosity and high water content can be used to create reconstituted tobacco in a process that resembles paper-making.

The sheet or web of homogenized tobacco material is then rolled in bobbins which need to be unwound in order to be further processed and included in the aerosol-forming substrate of the aerosol-forming article.

Typically, aerosol-generating articles comprise a plurality of components assembled in the form of a rod, including an aerosol-forming substrate. The aerosol-forming substrate may comprise a plurality of channels to provide air-flow through the rod. The channels affect the contact between the air, penetrating the aerosol-generating article, and the aerosol-forming substrate, as well as the resistance to draw (RTD) experienced by the user.

It may be desired to improve or modify the process to form an aerosol-generating article component, such as the aerosol-forming component substrate including a homogenized tobacco material, in terms of the users' smoking experience of the aerosol generated from said component.

Indeed, the pattern of the channels of the aerosol-forming substrate that provide air-flow through the rod may limit the contact between the air and the aerosol-forming substrate, for example lowering the efficiency of the air flow through the aerosol-generating article, the release of substances from the homogenized tobacco material of the aerosol-forming substrate to the air, or adversely affecting the RTD (resistance to draw) value experienced by the user.

There is therefore a need for a method of manufacturing an aerosol-generating article component, such as the aerosol-forming component substrate including a homogenized tobacco material that may satisfy the above needs of users' smoking experience of the aerosol generated from the component.

In particular, there is a need of a method of manufacturing an aerosol-generating article component that may be easily included into an aerosol generating article and may be used to obtain a desired contact between the air flowing through the aerosol-generating article and the aerosol-forming substrate.

The invention may satisfy at least one of the above needs.

In an aspect, the invention relates to a method of manufacturing an aerosol-generating article component, the method comprising the steps of: providing a web of a material containing alkaloids; feeding the web of a material containing alkaloids to an embossing device in a transport direction; embossing the web of a material containing alkaloids to form an embossed web of a material containing alkaloids by feeding the web between a first and a second embossing rollers so that the first and second embossing rollers apply an embossing pattern to the web, wherein the embossing pattern includes ridges or troughs extending in a direction substantially orthogonal to the transport direction; gathering the embossed web of a material containing alkaloids, and forming a continuous rod using the embossed web of a material containing alkaloids.

In another aspect, the invention relates to a method of manufacturing an aerosol-generating article component, the method comprising the steps of: providing a web of a material containing alkaloids having a thickness, the thickness of the web being comprised between about 100 micron and about 300 micron; feeding the web of a material containing alkaloids to an embossing device in a transport direction; embossing the web of a material containing alkaloids to form an embossed web of a material containing alkaloids by feeding the web between a first and a second embossing rollers so that the first and second embossing rollers apply an embossing pattern to the web, wherein the embossing pattern includes ridges or troughs extending in a direction substantially orthogonal to the transport direction; gathering the embossed web of a material containing alkaloids, and forming a continuous rod using the embossed web of a material containing alkaloids.

In the method of the invention, a web of a material containing alkaloids is provided. The web is fed in a transport direction to an embossing device including a first and second embossing rollers. The web is fed between the first and the second embossing rollers so that the first and second embossing rollers apply an embossing pattern to the web, wherein the embossing pattern includes ridges or troughs extending in a direction orthogonal to the transport direction. In this way, an embossed web of a material containing alkaloids is formed.

The embossed web including the material containing alkaloids may then be gathered into a continuous rod for producing an aerosol generating article including an aerosol-forming substrate that includes it. The air flowing through the aerosol-generating article may be influenced by the embossing pattern formed on the embossed web. In this way a desired contact between the air flowing in the rod and the material containing alkaloids included in the aerosol-forming substrate may be obtained. The users' smoking experience of the aerosol generated from the homogenized tobacco material of the aerosol-forming substrate is thus possibly improved.

As used herein, the terms "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters. A continuous "sheet" is herein called "web".

The sheet defines a first and a second surface, opposite to each other and substantially parallel to each other if the sheet rests on a planar surface.

As used herein, the term "width" refers to a dimension taken along a direction perpendicular to the length of a web or sheet, or in the case of a roller, a dimension parallel to an axis of the roller.

Preferably, the sheet is moved along a transport direction. The length of the sheet is preferably substantially parallel to the transport direction. Correspondingly, the width of the sheet is thus substantially perpendicular to the transport direction.

As used herein, the term "embossed" denotes a raised pattern formed on a surface. In "embossing", a design is formed, for example carved, moulded, stamped or others, on a surface of a sheet so that it stands out in relief. The embossed pattern includes a plurality of protrusions (also called bumps) on at least one of the sheet's surfaces. For example, the embossing process may form a plurality of peaks and valleys on the surface. Alternatively, a plurality of raised structures on an otherwise flat surface can be obtained.

As embossing step, a crimping step is preferably used. In a crimping step, two rollers are preferably used, which form a gap therebetween. In the gap, the web of material containing alkaloids is introduced. Preferably, the width of the gap is smaller than the thickness of the web. At least one of the rollers includes a given pattern on its surface. When the web is introduced in the gap, the pattern is transferred into the surface(s) of the web, forming thus the "protrusions".

A common pattern includes a plurality of ridges and valleys (or trough) parallel to each other.

As used herein, the expression "ridges" denotes a plurality of protrusions alternatively extending outwardly in a direction orthogonal to one or both the surface(s) of the sheet or web.

As used herein, the expression "troughs" denotes a plurality of protrusions alternatively extending inwardly in a direction orthogonal to the surface(s) of the sheet or web.

Typically, ridges and troughs may alternate each other on the web surface thus forming, in a section of the web taken along a plane perpendicular to the first and second surface of the sheet and parallel to the length of the sheet, a curve defining at least a pair of a tip and a bottom that may be either of a corner-type shape or of a rounded shape. For example, when a plurality of ridges and troughs alternate each other on the surface of a sheet, the sheet may show a wavy section.

The direction of extension of the ridges (or through) indicates the direction of the line defined by the uppermost (or lowermost) points formed in the sheet. Following the line formed by the tip of the ridges or by the deepest points in the troughs, the direction in which the ridge or trough extends is defined. The ridges or troughs preferably define each a direction of extension and the directions of the various ridges or troughs are preferably one parallel to the others. Preferably, all directions of extensions of the ridges and troughs are parallel to each other.

As used herein, the term "amplitude value" or "amplitude" denotes the distance between the lowermost and the uppermost point of the web's surface including a given embossing pattern in a direction perpendicular to the transport direction, minus the thickness of the web. For example, in the embossing pattern including a plurality of ridges and troughs, the amplitude denotes the distance between the uppermost point of the ridges and the lowermost point of the paired troughs in a direction perpendicular to the transport direction, minus the thickness of the web.

As used herein, the term "pitch value" or "pitch" denotes the distance between two consecutive protrusions, for example two consecutive ridges or troughs. This distance can be considered as the distance between two direction of extension of two consecutive ridges or troughs.

As used herein, the term "rod" denotes a generally cylindrical element of substantially circular or oval cross-section.

As used herein, the terms "gathered" or "gathering" denote that a web or sheet is convoluted, or otherwise compressed or constricted substantially transversely to the cylindrical axis of the rod.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine. The material containing alkaloids can include a homogenized tobacco material.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition may be then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet or web of homogenized tobacco material may be then rolled in bobbins which need to be unwound in order to be further processed, to be part for example of an aerosol-forming article, that is to be included in the aerosol-forming substrate of the aerosol-forming article. In a "heat-not-burn" aerosol-generating article, an aerosol-forming substrate is heated to a relatively low temperature, in order to form an aerosol but prevent combustion of the tobacco material. Further, the tobacco present in the homogenized tobacco sheet or web is typically the only tobacco, or includes the majority of the tobacco, present in the homogenized tobacco material of such a "heat-not-burn" aerosol-generating article. This means that the aerosol composition that is generated by such a "heat-not-burn" aerosol-generating article is substantially only based on the homogenized tobacco material.

As used herein, the term "aerosol forming material" denotes a material that is capable of releasing volatile compounds upon heating to generate an aerosol. Tobacco, together with other compounds, may be classed as an aerosol forming material, particularly a sheet of homogenized tobacco comprising an aerosol former. An aerosol forming substrate may comprise or consist of an aerosol forming material.

According to the method of the invention, a web of a material containing alkaloids is provided. The web defines a first and a second surface parallel to each other. It also defines a width, a length and a thickness. Width, length and thickness define a corresponding width direction, length direction, and thickness direction, respectively.

The web is fed to an embossing device in a transport direction. The transport direction is preferably parallel to the length of the sheet. Preferably, the transport direction is perpendicular to the width of the sheet.

The embossing device includes a first and second embossing roller, which form a gap, or "nip", therebetween. The first and second embossing rollers define a first and a second rotational axis. Preferably, the first and second rotational axis are parallel to each other. Preferably, the first and second rotational axis are parallel to the width of the sheet. Preferably, the first and second rotational axis are perpendicular to the transport direction.

On the surface of the first or second roller, preferably on both, an embossing pattern is defined. This embossing pattern includes ridges or troughs extending in a direction substantially orthogonal to the transport direction. The ridges or troughs, or both, define each an extension direction which is substantially orthogonal to the transport direction, which means that the two directions (extension direction and transport direction) may be angled by 90 degrees or a small deviation from the perfect orthogonality may be accepted as well. The ridges and troughs formed on the surface of the first or second roller have an extension and preferably this extension is parallel to the first or second rotational axis.

The web is introduced between the first and the second embossing rollers so that the first or second embossing rollers applies an embossing pattern on the first or second surface of the web, preferably on both, thus forming an embossed web of a material containing alkaloids. The embossing pattern on the web thus also includes a plurality of ridges or troughs.

Thus on the web, ridges and troughs extending in a direction substantially orthogonal to the transport direction (or the length of the sheet) are present.

The embossed web may then be gathered into a rod for producing an aerosol generating article.

The rod formed by the embossed web is included in the aerosol-forming substrate and, for this purpose, the embossed web is folded on itself so that a plurality of channels may be formed. During the users' smoking experience, air flows through the rod of the aerosol generating article and enters into contact with the web of the material containing alkaloids included in the aerosol-forming substrate. The embossing pattern present in the web may influence the flow of the air through the rod of the aerosol generating article and may modify the extent of the contact between the air and the aerosol-forming substrate including the material containing alkaloids. Indeed, the embossing, forming ridges or troughs perpendicularly to the transport direction, creates in the final product a block for the air flow. In the rod, the crimped sheet is folded in itself and the folding is performed substantially parallel to the transport direction (substantially along the length of the sheet). An embossing step comprising forming ridges parallel to the transport direction would form in the filter "channels" for the air because the channels are parallel to the rod extension. Ridges or troughs, however, formed perpendicularly to the air flow modify this behaviour. The path of the air flowing in the longitudinal axis of the rod, which is the direction favored by the configuration of the smoking article (air enter at one tip of the smoking article and is drawn at the other) and the transverse embossed grooves/ridges cause a "stop" in the flowing air, which may help stripping the aerosol-forming substrate of more sensorial media particles and carry them into the air flow.

In this way, a desired contact between the air flowing in the aerosol generating article and the material containing alkaloids may be obtained and the users' smoking experience generated from the aerosol-forming article including the material containing alkaloids is thus possibly improved.

Preferably, the web of a material containing alkaloids has a web width and the step of embossing the web of a material containing alkaloids includes forming ridges or troughs which extend for at least about 20 percent of the web width of the embossed web, more preferably for at least about 30 percent of the web width of the embossed web, even more preferably for at least about 40 percent of the web width of the embossed web, even more preferably for at least about 50 percent of the web width of the embossed web, even more preferably for at least about 60 percent of the web width of the embossed web, even more preferably for at least about 70 percent of the web width of the embossed web, even more preferably for at least about 80 percent of the web width of the embossed web, still even more preferably for at least about 90 percent of the web width of the embossed web.

The extension of the ridges or troughs along their extension as defined above may not cover the whole width of the sheet. Only a part of the width may be covered by ridges or troughs. In addition, the ridges or troughs do not have to be continuous, that is, along the same direction of extension, several ridges or troughs may be aligned one after the other (in series) so that a sort of "interrupted" long ridge or long trough is formed. The extension of the ridges and troughs is preferably parallel to the width of the sheet. Preferably, the extension of the ridges and the troughs is perpendicular to the length of the sheet or to the transport direction.

Preferably, the ridges or troughs form an angle with the transport direction comprised between about 82 degrees and about 98 degrees, more preferably an angle with the transport direction comprised between about 84 degrees and about 96 degrees, even more preferably an angle with the transport direction comprised between about 85 degrees and about 95 degrees.

"The ridges or troughs form an angle with the transport direction" means that the mentioned angle is formed between the direction defined by the extension of the ridges or troughs and the transport direction.

Ridges or troughs may not be perfectly perpendicular to the transport direction. This non orthogonality may be due by mechanical misalignment, positioning lack or precision, or may be desired. Therefore an angle between about 85 degrees and about 95 degrees between the transport direction and the extension defined by the ridges or troughs is the meaning of the "substantially orthogonal" wording.

Preferably, the embossing pattern includes a portion free from ridges or troughs.

As used herein, "free from ridges or troughs" means that in the portion of the web referred to, the embossing rollers have not formed any corrugations. However accidental bends and wrinkles-due to the nature of the web itself-might be present and the web surface might not be completely smooth.

Preferably, the portion of the embossing pattern free from ridges or troughs forms a strip running substantially parallel to the transport direction.

Preferably, the method of the invention comprises the step of unwinding a bobbin comprising a wound web of a material containing alkaloids in such a way to provide the web of a material containing alkaloids.

In this way, the method of the invention may be used for producing aerosol-generating article components starting from previously prepared bobbins of alkaloids containing materials. Preferably, this step of unwinding a bobbin takes place before providing a web of a material containing alkaloids.

Preferably, an amplitude of the ridges or troughs is comprised between about 10 and about 300 percent of the thickness of the web, more preferably between about 15 and about 250 percent of the thickness of the web, even more preferably between about 25 and about 200 percent of the thickness of the web, still even more preferably between about 30 and about 150 percent of the thickness of the web.

This amplitude has proven to be optimal to obtain the desired characteristics in the rod gathered from the embossed web. For example, the desired contact between the air flowing through the rod and the aerosol generating substrate including the web of material containing alkaloids is obtained. Preferably, with this amplitude range of the ridges or troughs, the desired RTD value is obtained.

Preferably, the ridges or troughs have a pitch comprised between about 50 and about 1000 percent of the thickness of the web, more preferably between about 100 and about 750 percent of the thickness of the web, more preferably between about 200 and about 600 percent of the thickness of the web.

This pitch has proven to be optimal to obtain the desired characteristics in the bobbin. For example, the desired contact between the air flowing through the rod and the aerosol generating substrate including the web of material containing alkaloids is obtained.

Preferably, the method includes the step of embossing the web of a material containing alkaloids to form an embossed web of a material containing alkaloids by feeding the web between a third and a fourth embossing rollers so that the third and fourth embossing rollers apply a second embossing pattern to the web, wherein the second embossing pattern includes ridges or troughs extending in a second direction forming an angle different from zero with the direction orthogonal to the transport direction.

Preferably, the second direction is substantially parallel to the transport direction. "Substantially parallel" means that the angle formed between the second direction and the transport direction is smaller than about 8 degrees.

The pattern applied by the first and second roller may be not the only pattern realized on the web. A further pattern may be formed, having ridges or troughs which extend along a second direction which is not again orthogonal to the transport direction. A preferred second direction is a direction parallel to the transport direction, so that the end pattern formed on the web is substantially a "grid" or "matrix" of ridges and troughs.

The third and fourth embossing rollers may coincide with the first and second embossing rollers. For example, on the first or on the second embossing roller a patterned surface portion which includes a grid pattern is formed.

The surface of the first or second roller has a plurality of protrusions including ridges and/or troughs extending along more than one direction, for example a first group of ridges and/or troughs extends in a direction orthogonal to a transport direction and a second group of ridges and/or troughs extends in a second direction which is not perpendicular to the transport direction. The first direction is different from the second direction.

Preferably, the web of a material containing alkaloids has a thickness of between about 100 micron and about 300 micron. Preferably, the thickness of the web of a material containing alkaloids is the "standard" thickness used for the production of aerosol generating articles, for example of about 200 micron. There is no need of modifying standard process steps. The ridges and/or troughs formed in a web having its thickness within the above range allow to obtain an embossed web with which a rod having a correct air flow during smoking can be fabricated. The thickness of the web in the claimed range is such that the embossing step can deform the sheet properly (the embossing pattern can be transferred from the rollers to the sheet), at the same time avoiding breakage of the sheet. The claimed thickness is measured before the sheet is inserted between the embossing rollers, preferably just before being inserted.

Preferably, the web has a thickness comprised between about 100 micron and about 300 micron and the ridges or troughs have an amplitude comprised between 30 micron and about 300 micron, corresponding to an amplitude comprised between about 10 percent and about 300 percent of the thickness of the web, and a pitch comprised between 200 micron and about 1000 micron, corresponding to a pitch comprised between about 50 percent and about 1000 percent of the thickness of the web.

Preferably, the web of a material containing alkaloids has a width from between about 0.1 meters to about 2 meters.

Preferably, the method of the invention comprises the step of cutting said web of a material containing alkaloids in a direction which is substantially parallel to the transport direction and perpendicular to the width of the web, in such a way to provide two partial webs of a material containing alkaloids, each having a width smaller than the width of the web before cutting. In this way, a web is preferably divided in two by cutting two distinct partial webs having a width smaller than the width of the web before cutting.

Preferably, the above described cutting step takes place before the step of embossing the web of a material containing alkaloids. In this way, two different embossed partial webs could be formed in parallel along the production line, thus furthermore increasing the overall productivity of the process.

Preferably, in the method of the invention, the material containing alkaloids is a tobacco material. Preferably, the material containing alkaloids may contain a single alkaloid, or more than a single alkaloid. Preferably, the alkaloids include tobacco.

Preferably, the web of a material containing alkaloids has a moisture content comprised between from about 7 percent to about 15 percent in total weight basis of the web. At this moisture content, the web is substantially solid and relatively easy to handle.

Preferably, the web of a material containing alkaloids comprises: particles of the material containing alkaloids having a mean size per weight comprised between about 0.03 millimetres and about 0.12 millimetres; a binder; and water.

Preferably, the web of a material containing alkaloids comprises from about 1 percent and about 5 percent in dry weight basis of the binder.

Preferably, the web of a material containing alkaloids comprises from about 45 percent and about 93 percent in dry weight basis of particles of a material containing alkaloids.

Preferably, the web of a material containing alkaloids comprises from about 1 percent to about 7 percent per weight on a dry weight basis of cellulose fibres. More preferably, the cellulose fibres have a mean length comprised between about 0.2 millimetres and about 4 millimetres.

Preferably, the web of a material containing alkaloids comprises between about 5 percent and about 30 percent in dry weight basis of an aerosol-former.

Preferably, the method of the invention comprises the step of wrapping the rod.

Preferably, the method comprises the steps of cutting the continuous rod into a plurality of rod-shaped components, each rod-shaped component having a gathered embossed web formed from a cut portion of the embossed web, the embossing pattern of the embossed web defining a plurality of channels in the rod-shaped component. The resulting products may suit the needs of the end-consumer particularly well.

According to a second aspect, the invention relates to an apparatus for manufacturing an aerosol-generating article component, the apparatus including: a feed path adapted to continuously feed a web of a material containing alkaloids along a transport direction; an embossing device adapted to collect the web of a material containing alkaloids and to apply an embossing pattern to the web in such a way to form an embossed web, the embossing device including a first and a second embossing rollers forming a gap therebetween, the first and the second embossing roller being adapted to rotate around a first and second rotation axis, respectively, the first and second rotation axis being parallel, and wherein at least one of the first and second embossing rollers includes a patterned surface portion including a plurality of ridges or troughs forming locally an angle comprised between about 0 degree and 8 degrees with the rotation axis of the respective roller; and a rod forming device at a point downstream the embossing device along the transport direction and adapted to gather the embossed web and to form a continuous rod using the embossed web of a material containing alkaloids.

According to a third aspect, the invention relates to a kit comprising a web of a material containing alkaloids having a thickness, the thickness of the web of the material containing alkaloids being comprised between about 100 micron and about 300 micron; an apparatus for manufacturing an aerosol-generating article component, the apparatus including: a feed path adapted to continuously feed a web of a material containing alkaloids along a transport direction; an embossing device adapted to collect the web of a material containing alkaloids and to apply an embossing pattern to the web in such a way to form an embossed web, the embossing device including a first and a second embossing rollers forming a gap therebetween, the first and the second embossing roller being adapted to rotate around a first and second rotation axis, respectively, the first and second rotation axis being parallel, and wherein at least one of the first and second embossing rollers includes a patterned surface portion including a plurality of ridges or troughs forming locally an angle comprised between about 0 degree and 8 degrees with the rotation axis of the respective roller; and a rod forming device at a point downstream the embossing device along the transport direction and adapted to gather the embossed web and to form a continuous rod using the embossed web of a material containing alkaloids.

The advantages of the second and third aspect have been already outlined with reference to the first aspect and are not repeated herewith.

Preferably, at least one of the first and second embossing rollers includes a surface portion free from ridges or troughs.

Preferably, the surface portion free from ridges or troughs has a cylindrical shape.

Preferably, the ridges or troughs form locally an angle comprised between about 0 degree and 6 degrees with the rotation axis of the respective roller, more preferably the ridges or troughs form locally an angle comprised between about 0 degree and 5 degrees with the rotation axis of the respective roller.

"The ridges or troughs form an angle with the rotation axis" means that the mentioned angle is formed between the direction defined by the extension of the ridges or troughs and the direction defined by the rotation axis of the first or second embossing rollers.

Preferably, the ridges or troughs are adapted to define on the web a plurality of ridges or troughs having an amplitude comprised between about 10 and about 300 percent of the thickness of the web, more preferably between about 15 and about 250 percent of the thickness of the web, even more preferably between about 25 and about 200 percent of the thickness of the web, still even more preferably between about 30 and about 150 percent of the thickness of the web.

Preferably, the ridges or troughs are adapted to define on the web a plurality of ridges or troughs having a pitch comprised between about 50 and about 1000 percent of the thickness of the web, more preferably between about 100 and about 750 percent of the thickness of the web, more preferably between about 200 and about 600 percent of the thickness of the web.

In order to form embossing rollers adapted to form on the web a plurality of ridges or troughs having a pitch or an amplitude within the mentioned ranges, the ridges or troughs formed on the surface of the first or second embossing rollers, or both, is preferably selected with a defined amplitude and pitch, however, the material of the embossing rollers and the distance between the first and second embossing rollers are relevant parameters as well. Further, also the material in which the web is formed is a relevant parameter.

The pitch or the amplitude of the ridges or troughs is selected in the above mentioned range is order to obtain the desired RTD in the final product.

According to a third aspect, the invention relates to an aerosol generating article including the aerosol-generating article component realized according to the first aspect of the invention.

The advantages of the third aspect have been already outlined with reference to the first and second aspects and are not repeated herewith.

Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material without combustion or heating.

Aerosol forming articles according to the invention may be whole, assembled aerosol forming articles or components of aerosol forming articles that are combined with one or more other components in order to provide an assembled article for producing an aerosol, such as for example, the consumable part of a heated smoking device.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may alternatively be partially-reusable and comprise a replenishable or replaceable aerosol forming substrate.

An aerosol forming article may also include a combustible cigarette. In preferred embodiments, the aerosol forming-article may be substantially cylindrical in shape. The aerosol forming article may be substantially elongated. The aerosol forming article may have a length and a circumference substantially perpendicular to the length. The aerosol forming article may have a total length between approximately about 30 millimeters and approximately about 100 millimeters. The aerosol forming article may have an external diameter between approximately about 5 millimeters and approximately about 12 millimeters.

In all the aspects of the invention, preferably, the web of a material containing alkaloids is a homogenized tobacco web, where the material containing alkaloids is tobacco containing nicotine.

Preferably, the homogenized tobacco web is obtained casting a slurry.

The homogenized tobacco web includes tobacco particles grinded from tobacco leaves (for example tobacco stem and lamina).

The homogenized tobacco web may also comprise a minor quantity of one or more of tobacco dust, tobacco fines, and other particulate tobacco by-products formed during the treating, handling and shipping of tobacco.

The tobacco present in the homogenized tobacco material may constitute the majority of the tobacco, or even substantially the total amount of tobacco present in the aerosol-generating article. The impact on the characteristics of the aerosol, such as its flavour, may derive predominantly from the homogenized tobacco material. It is preferred that the release of substances from the tobacco present in the homogenized tobacco material is simplified, in order to optimize use of tobacco. In the following, the term "tobacco particles" is used through the specification to indicate tobacco having a mean size per weight between about 0.03 millimetres and about 0.12 millimetres.

Tobacco particles having a mean particle size by weight between about 0.03 millimetres and about 0.12 millimetres may improve the homogeneity of the slurry. The quantity of binder added to the blend of one or more tobacco types is preferably comprised between about 1 percent and about 5 percent in dry weight of the slurry. The binder used in the slurry may be any of the gums or pectins described herein. The binder may ensure that the tobacco powder remains substantially dispersed throughout the homogenized tobacco web. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

The homogenized tobacco material comprises preferably between about 45 percent and about 93 percent in dry weight basis of tobacco particles.

Preferably, the homogenized tobacco sheet also includes a binder.

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Preferably, binder is in an amount comprised between about 1 percent and about 5 percent in dry weight basis of the homogenized tobacco web. More preferably, it is comprised between about 2 percent and about 4 percent.

Preferably, the homogenized tobacco web also includes cellulose fibers, in addition to the cellulose fibers already present in the tobacco.

Cellulose fibres may be introduced in the slurry. The introduction of cellulose fibres in the slurry typically increases the tensile strength of the tobacco material web, acting as a strengthening agent. Therefore, adding cellulose fibres may increase the resilience of the homogenized tobacco material web.

Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof.

Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo.

The length of cellulose fibres is advantageously between about 0.2 millimetres and about 4 millimetres. Preferably, the mean length per weight of the cellulose fibres is between about 1 millimetre and about 3 millimetres.

Further, preferably, the amount of the cellulose fibres is comprised between about 1 percent and about 7 percent in dry weight basis of the total weight of the slurry (or homogenized tobacco web).

Advantageously, the method comprises the step of adding an aerosol-former to the slurry. Suitable aerosol-formers for inclusion in slurry for homogenised tobacco material are known in the art and include, but are not limited to: monohydric alcohols like menthol, polyhydric alcohols, such as triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerin and propylene glycol.

The homogenized tobacco material may have an aerosol-former content of greater than about 5 percent on a dry weight basis. The homogenized tobacco material may alternatively have an aerosol former content of between about 5 percent and about 30 percent by weight on a dry weight basis. More preferably, the aerosol-former is comprised between about 10 percent to about 25 percent of dry weight of the homogenized tobacco material. More preferably, the aerosol-former is comprised between about 15 percent to about 25 percent of dry weight of the homogenized tobacco material.

The binder and the cellulose fibers are preferably included in a weight ratio comprised between about 1:7 and about 5:1. More preferably, the binder and the cellulose fibers are included in a weight ratio comprised between about 1:1 and about 3:1.

The binder and the aerosol-former are preferably included in a weight ratio comprised between about 1:30 and about 1:1. More preferably, the binder and the aerosol-former are included in a weight ratio comprised between about 1:20 and about 1:4.

The binder and the tobacco particles are preferably included in a weight ratio comprised between about 1:100 and about 1:10. More preferably, the binder and the tobacco particles are included in a weight ratio comprised between about 1:50 and about 1:15, even more preferably between about 1:30 and 1:20.

The aerosol-former and the tobacco particles are preferably included in a weight ratio comprised between about 1:20 and about 1:1. More preferably, the aerosol-former and the tobacco particles are included in a weight ratio comprised between about 1:6 and about 1:2.

The aerosol former and the cellulose fibres are preferably included in a weight ratio comprised between about 1:1 and about 30:1. More preferably, the aerosol-former and the cellulose fibres are included in a weight ratio comprised between about 5:1 and about 15:1.

The cellulose fibres and the tobacco particles are preferably included in a weight ratio comprised between about 1:100 and about 1:10. More preferably, the cellulose fibres and the tobacco particles are preferably included in a weight ratio comprised between about 1:50 and about 1:20.

The above mentioned weight ratios of the ingredients of the homogenized tobacco web are applicable not only to the homogenized tobacco web, but also they are the weight ratios of the various ingredients present in the slurry.

A web of homogenized tobacco material is preferably formed by a casting process of the type generally comprising casting a tobacco slurry onto a moving metal belt. Preferably, the cast web is dried to form a web of homogenized tobacco material and it is then removed from the support surface.

The invention may also relate to a method of manufacturing an aerosol-generating article component, the method comprising the steps of: providing a web of a material; feeding the web of a material to an embossing device in a transport direction; embossing the web of a material to form an embossed web of a material by feeding the web between a first and a second embossing rollers so that the first and second embossing rollers apply an embossing pattern to the web, wherein the embossing pattern includes ridges or troughs extending in a direction substantially orthogonal to the transport direction; gathering the embossed web of a material, a forming a continuous rod using the embossed web of a material.

The invention may also relate to an apparatus for manufacturing an aerosol-generating article component, the apparatus including: a feed path adapted to continuously feed a web of a material along a transport direction; an embossing device adapted to collect the web of a material and to apply an embossing pattern to the web in such a way to form an embossed web, the embossing device including a first and a second embossing rollers forming a gap therebetween, the first and the second embossing roller being adapted to rotate around a first and second rotation axis, respectively, the first and second rotation axis being parallel, and wherein at least one of the first and second embossing rollers includes a patterned surface portion including a plurality of ridges or troughs forming locally an angle comprised between about 0 degree and 8 degrees with the rotation axis of the respective roller; and a rod forming device at a point downstream the embossing device along the transport direction and adapted to gather the embossed web and to form a continuous rod using the embossed web of a material.

Specific embodiments of the invention will be further described, by way of example only, with reference to the accompanying drawings in which.

Figure 1:
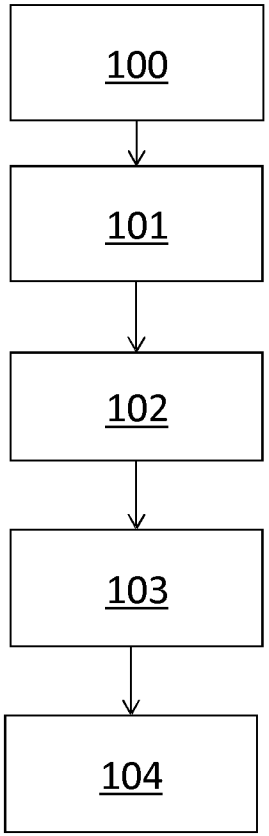
FIG. 1 shows a flow diagram of the method of the invention to produce an aerosol-generating article component.

With initial reference to FIG. 1, a method for producing an aerosol-generating article component of the invention is represented.

Figure 3:
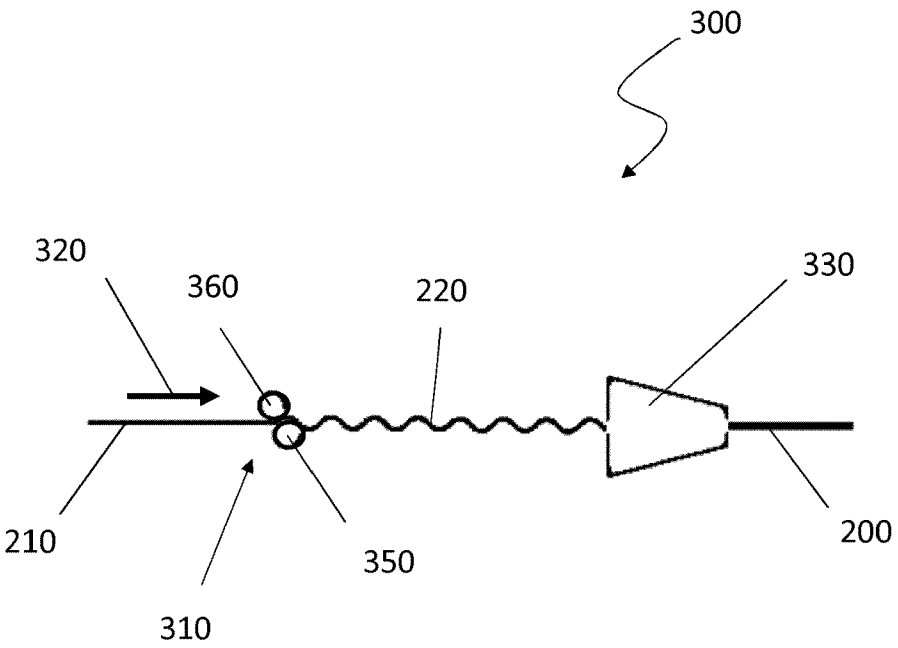
FIG. 3 is a lateral schematic view of an apparatus for carrying out the method of the invention to produce an aerosol-generating article component.

The first step 100 of the method of the invention includes the provision of a web 210 of a material containing alkaloids (visible in FIG. 3). Material containing alkaloids to be used in the method of the invention preferably includes a homogenized tobacco material. Preferably, in step 100, the homogenized tobacco web 210 has a thickness of about 0.2 millimetres (about 200 micron) and a width from between about 0.1 meters to about 2 meters.

Figure 2:
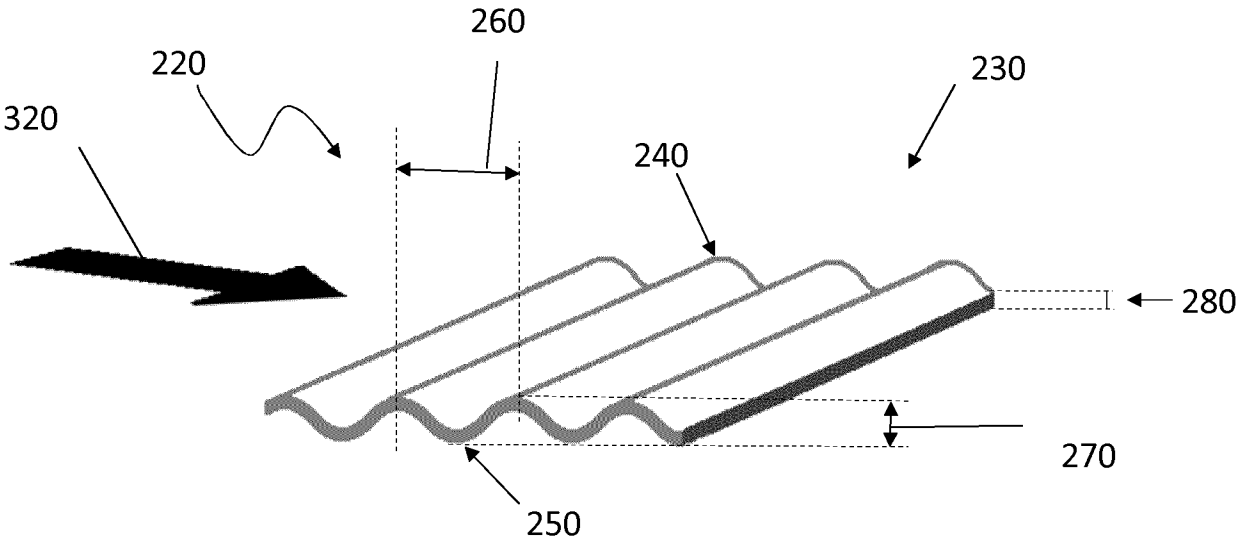
FIG. 2 is a perspective schematic view of an embossed web of a material containing alkaloids obtained from the embossing step of the method of the invention.
Figure 4:
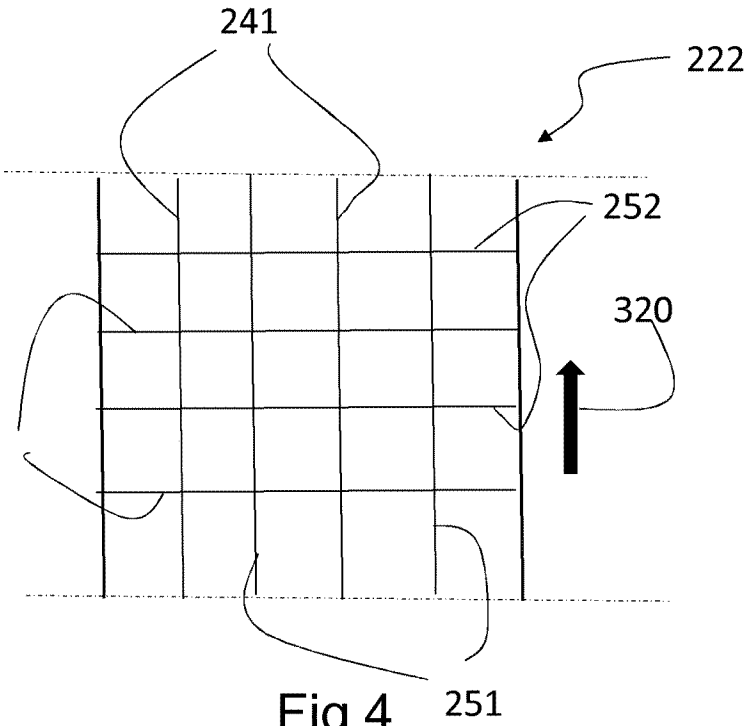
FIG. 4 is a top view of an embossed web of a material containing alkaloids obtained from the embossing step of the method of the invention according to a second embodiment.

The method includes a further step 101 in which the web 210 is fed to an embossing device 310 (visible in FIG. 3) in a transport direction 320 (indicated by arrow 320 in FIGS. 2-4).

Further, the method of the invention includes a step 102 of embossing the web 210 of a material containing alkaloids to form an embossed web 220 of a material containing alkaloids.

In particular, step 102 of embossing comprises feeding the web 210 between a first and a second embossing rollers (indicated by 350, 360 in FIG. 3) of the embossing device 310, that apply an embossing pattern (indicated by 230 in FIG. 2) to the web, wherein the embossing pattern includes ridges 240 and corresponding paired troughs 250 extending in a direction orthogonal to the transport direction 320. Preferably, an amplitude of ridges 240 is of about 0.2 millimeters (about 200 micron, corresponding to about 100 percent of the thickness 280 of the web).

Preferably, the ridges 240 have a pitch of about 1 millimeter (about 1000 micron, corresponding to about 500 percent of the thickness 280 of the web).

After step 102, the method of the invention includes a step 103 in which the embossed web 220 of a material containing alkaloids is gathered and a continuous rod 200 (visible in FIG. 3) is formed using the embossed web 220 in step 104.

In FIG. 2, a perspective schematic view of an embossed web 220 of a material containing alkaloids obtained from the embossing step of the method of the invention is shown.

In FIG. 2, the transport direction of the web in the process of the invention is represented by arrow 320.

The embossing pattern 230 includes a ridge 240 and a corresponding paired trough 250, ridge 240 having an amplitude 270 comprised between about 10 and about 150 percent of the thickness 280 of the web and a pitch 260 comprised between about 100 and about 500 percent of the thickness 280 of the web.

In FIG. 4, an additional embossed web 222 is disclosed in a top view, where a "matrix" of ridges and troughs is formed. A first plurality of ridges 241 and troughs 251 extends along the transport direction 320, while a second plurality of ridges 242 and troughs 252 extends in a direction perpendicular to the transport direction, forming a grid pattern.

In FIG. 3, an apparatus 300 for carrying out the method of the invention is shown.

The apparatus 300 includes an embossing device 310 and a rod forming device 330.

The embossing device 310 includes a first and a second embossing rollers 350, 360. The embossing rollers have each a surface on which an embossing pattern is defined.

The web 210 of a material containing alkaloids is fed between the first and a second embossing rollers 350, 360 of the embossing device 310 in a transport direction, indicated by arrow 320.

At the exit of the embossing device 310, an embossed web 220 of a material containing alkaloids is obtained. The embossed web is formed by transferring the embossing pattern from the embossing rollers to the web.

The embossed web 220 is then fed to the rod forming device 330.

In the rod forming device 330, the embossed web 220 is gathered and a continuous rod 200 is formed.

The invention claimed is:

1. A kit comprising:

a web of a material containing alkaloids having a thickness, the thickness of the web of the material containing alkaloids being comprised between about 100 micron and about 300 micron; and an apparatus for manufacturing an aerosol-generating article component, the apparatus including:

a feed path adapted to continuously feed a web of a material containing alkaloids along a transport direction;

an embossing device adapted to collect the web of a material containing alkaloids and to apply an embossing pattern to the web in such a way to form an embossed web, the embossing device including a first and a second embossing rollers forming a gap therebetween, the first and the second embossing roller being adapted to rotate around a first and second rotation axis, respectively, the first and second rotation axis being parallel, and wherein at least one of the first and second embossing rollers includes a patterned surface portion including a plurality of ridges or troughs forming locally an angle comprised between about 0 degree and 8 degrees with the rotation axis of the respective roller, and wherein the ridges or troughs are adapted to define on the web a plurality of ridges or troughs having an amplitude comprised between about 10 and about 300 percent of the thickness of the web; and a rod forming device at a point downstream the embossing device along the transport direction and adapted to gather the embossed web and to form a continuous rod using the embossed web of a material containing alkaloids.

2. The kit according to claim 1, wherein at least one of the first and second embossing rollers includes a surface portion free from ridges or troughs.

3. The kit according to claim 2, wherein the surface portion free from ridges or troughs has a cylindrical shape.

4. Kit according to claim 1, wherein the ridges or troughs are adapted to define on the web a plurality of ridges or troughs having a pitch comprised between about 50 and about 1000 percent of the thickness of the web.

5. The kit according to claim 1, wherein at least one of the first and second embossing rollers includes a patterned surface portion including a plurality of ridges or troughs forming locally an angle comprised between about 5 degree and 8 degrees with the rotation axis of the respective roller.

6. The kit according to claim 1, wherein a third and a fourth embossing roller are provided, wherein the third and fourth embossing rollers apply a second embossing pattern to the web, wherein the second embossing pattern includes ridges or troughs extending in a second direction, wherein the second direction is a direction parallel to the transport direction.

7. The kit according to claim 1, wherein the surface of the first or second roller has a plurality of protrusions including ridges and/or troughs extending along more than one direction.

8. The kit according to claim 1, wherein the apparatus includes a third and a fourth embossing roller, wherein the third and fourth embossing rollers apply a second embossing pattern to the web, wherein the second embossing pattern includes ridges and troughs extending in a second direction, wherein the second direction is a direction parallel to the transport direction, and wherein a grid of ridges and troughs are formed.

9. The kit according to claim 1, wherein on the first or on the second embossing roller a patterned surface portion which includes a grid pattern is formed.

* * * * *